US010837264B2

(12) United States Patent
Filippov et al.

(10) Patent No.: US 10,837,264 B2
(45) Date of Patent: Nov. 17, 2020

(54) CASING PATCH SYSTEM

(71) Applicant: Mohawk Energy Ltd., Houston, TX (US)

(72) Inventors: Andrei G. Filippov, Houston, TX (US); Scott A. Benzie, Houston, TX (US); Alessandro Caccialuppi, Houston, TX (US)

(73) Assignee: Mohawk Energy Ltd., Houston, TX (US)

( * ) Notice: Subject to any disclaimer, the term of this patent is extended or adjusted under 35 U.S.C. 154(b) by 28 days.

(21) Appl. No.: 16/056,205

(22) Filed: Aug. 6, 2018

(65) Prior Publication Data

US 2019/0048692 A1 Feb. 14, 2019

Related U.S. Application Data

(60) Provisional application No. 62/543,758, filed on Aug. 10, 2017.

(51) Int. Cl.
*E21B 43/10* (2006.01)
*E21B 29/10* (2006.01)
(Continued)

(52) U.S. Cl.
CPC ..... *E21B 43/105* (2013.01); *E21B 23/01* (2013.01); *E21B 23/03* (2013.01); *E21B 23/06* (2013.01); *E21B 29/10* (2013.01); *E21B 43/106* (2013.01)

(58) Field of Classification Search
CPC ..... E21B 43/105; E21B 23/06; E21B 29/10; E21B 43/106; E21B 23/03; E21B 23/01; E21B 43/103
See application file for complete search history.

(56) References Cited

U.S. PATENT DOCUMENTS 6,085,838 A 7/2000 Vercaemer et al.
7,493,946 B2 2/2009 Filippov et al.
(Continued)

FOREIGN PATENT DOCUMENTS

GB 2525830 4/2015

OTHER PUBLICATIONS

International Search Report and Written Opinion for Application No. PCT/US18/45633 dated Nov. 19, 2018.
(Continued)

*Primary Examiner* — Giovanna Wright
*Assistant Examiner* — Manuel C Portocarrero
(74) *Attorney, Agent, or Firm* — Tumey L.L.P.

(57) ABSTRACT

A casing patch system comprising a base tubular with two anchor/seals coupled to the base tubular and an expansion tool comprising two expansion devices positioned such that upon expansion of the first anchor/seal, the second expansion device engages the second anchor/seal, which allows reduction of the expansion forces due to sequential expansion and reduces the length of the displacement necessary for setting the casing patch, eliminating the need for resetting the thruster, which allows deployment and setting of the casing patch on a wireline. In another embodiment, the expansion device comprises two swages coupled to a shaft at a distance between them approximately equal to the length of the anchor/seal. The swage diameters are selected such that the expansion forces of the anchor/seal by front and back swages are approximately equal, resulting in significantly less expansion force compared to the expansion force necessary for expansion by a single swage, which allows a high degree of anchor/seal expansions unachievable by single swage expansion devices.

19 Claims, 5 Drawing Sheets

(51) Int. Cl.

| | |
|---|---|
| ***E21B 23/06*** | (2006.01) |
| ***E21B 23/01*** | (2006.01) |
| ***E21B 23/03*** | (2006.01) |

(56) References Cited

U.S. PATENT DOCUMENTS

| | | | |
|---|---|---|---|
| 7,552,776 | B2 | 6/2009 | Noel |
| 2005/0161226 | A1 | 7/2005 | Duggan et al. |
| 2007/0221374 | A1 | 9/2007 | Filippov et al. |
| 2007/0272418 | A1 | 11/2007 | Corre et al. |
| 2010/0252278 | A1 | 10/2010 | Harris et al. |
| 2012/0097391 | A1 | 4/2012 | Whiddon |
| 2012/0211222 | A1 | 8/2012 | Leighton et al. |
| 2012/0273236 | A1 | 11/2012 | Gandikota et al. |
| 2013/0299169 | A1 | 11/2013 | Rex et al. |
| 2016/0032696 | A1 | 2/2016 | Caccialupi et al. |

OTHER PUBLICATIONS

International Preliminary Report on Patentability for PCT/US2018/0453633 dated Feb. 11, 2020.

CASING PATCH SYSTEM

CROSS-REFERENCE TO RELATED APPLICATIONS

This application claims the benefit of U.S. Provisional Application No. 62/543,758 filed Aug. 10, 2017.

STATEMENT REGARDING FEDERALLY SPONSORED RESEARCH OR DEVELOPMENT

Not applicable.

BACKGROUND OF THE INVENTION

Field of the Disclosure

This invention relates generally to hydrocarbon exploration and production, and more specifically to the field of casing patches for wellbore casings.

Background of the Disclosure

Methods and apparatus utilized in the oil and gas industry enable patching of wellbore casing in a borehole to isolate damaged areas such as leaking connections, corroded or damaged areas, etc. Many examples of patching techniques exist including patents, such as UK Pat. No. GB2,525,830, owned by the assignee of the present invention. However, prior patching techniques may not be possible or desirable in some applications. Further, issues that present problems with some of these approaches may include the need to use a drill-string or a coiled tubing to enable resetting of the expansion tool for stroking the swage multiple times to complete the setting of the patch to the existing casing. In some cases, the most economical and desirable method of installation of patches in wellbore casings may be deploying and setting the patch utilizing a wireline. However, wireline may not have an adequate strength or weight for resetting of the expansion tool.

What is needed is a method and apparatus to allow repair of damaged wellbore casings in a single trip using an expansion device capable of deploying and fixing a casing patch utilizing a wireline. The method features setting a casing patch in a single stroke of the expander utilizing a dual expansion device system.

BRIEF SUMMARY OF SOME OF THE PREFERRED EMBODIMENTS

These and other needs in the art may be addressed in embodiments by a system and method for installing a casing patch in a wellbore.

In accordance with the invention there is provided a casing patch system for installing a casing patch in a wellbore formed in an earth formation, the casing patch system comprising a base tubular comprising an internal diameter, and a first anchor/seal and a second anchor/seal coupled to the base tubular, wherein internal diameters of the first and the second anchor/seals are less than the internal diameter of the base tubular. Further, the casing patch system may comprise an expansion tool comprising a first expansion device and a second expansion device coupled to a shaft; a second expansion device positioned inside the base tubular between the first and second anchor/seals, and a distance between the first and second expansion devices selected such that upon expansion of the first anchor/seal by the first expansion device the second expansion device approximately engages the second anchor/seal; and a thruster coupled to a releasable support and the shaft, and the thruster is capable of providing a force necessary for expansion of the anchor/seals.

A casing patch is thereby achieved by positioning expansion devices as described above to minimize the expansion force due to sequential expansion and the length of the displacement necessary for setting the casing patch without resetting the thruster, instead of stroking the thruster multiple times as in previous efforts, which allows deployment and setting of the casing patch on a wireline.

In an alternative embodiment of the present invention, the expansion device may comprise a dual swage system comprising a front swage and a back swage coupled to a shaft at a distance between them approximately equal to the length of the anchor/seal. The front swage has a diameter less than the diameter of the back swage. The swage diameters may be selected such that the expansion forces of the anchor/seal by the front and back swages may be approximately equal, resulting in significantly less expansion forces compared to the expansion force necessary for expanding an anchor/seal by a single swage. This may prevent localized buckling of the anchor/seals or base tubular in cases of high expansion ratios for setting anchor/seals to the well casing.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
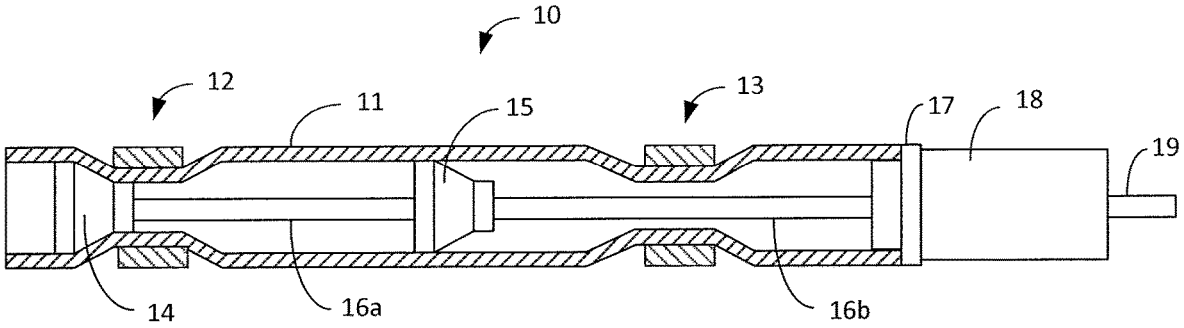
FIG. 1 is a schematic, partial view of one embodiment of a casing patch system shown in a run-in configuration.

FIG. 1 illustrates an embodiment of a casing patch system 10 comprising a base tubular 11, which comprises a first anchor/seal 12 and a second anchor/seal 13; an expansion tool 30 (FIG. 3), which comprises a first expansion device 14 and a second expansion device 15, solidly attached to first shaft 16*a* and a second shaft 16*b*; a releasable support 17; a thruster 18; and a conduit 19. The thruster 18 may have multiple pressure chambers to provide a force necessary for radially expanding first anchor/seal 12 by the first expansion device 14 and then second anchor/seal 13 by the second expansion device 15. The releasable support 17 provides a reaction force necessary for expansion of first and second anchor/seals 12 and 13. The casing patch system 10 may be deployed in a well on conduit 19, which may be a wireline with a pressure pump to provide pressure for thruster 18, or alternatively on a coiled tubing or a drill pipe.

Figure 2:
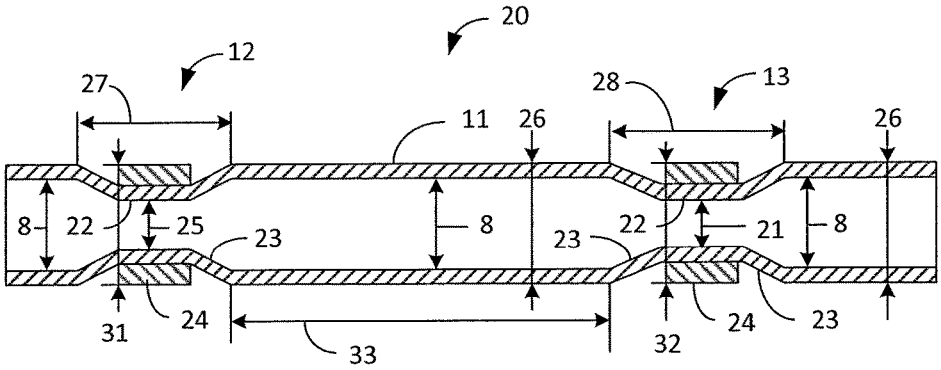
FIG. 2 is a schematic view of the casing patch of the casing patch system shown in FIG. 1.

FIG. 2 illustrates a schematic cross-sectional view of a casing patch 20 of the casing patch system 10. Casing patch 20 comprises base tubular 11 having an internal diameter 8 and an external diameter 26 as well as first and second anchor/seals 12 and 13. The first and second anchor/seals 12 and 13 may have middle portions 22 with internal diameters 25 and 21, respectively, which are less than the internal diameter 8 of the base tubular 11. Further, first and second anchor/seals 12 and 13 may comprise transition portions 23 with internal diameters tapered from internal diameter 8 to internal diameter 21 or 25 of the middle portions 22. One or more sealing/anchoring elements 24 may be coupled to the outside surface of the middle portions 22 of the first and second anchor/seals 12 and 13. Outside diameters 31 and 32 of first and second anchor/seals 12 and 13, respectively, and external diameter 26 of the base tubular 11 may be less than the minimum internal diameter of a well casing (not illustrated) including restrictions such as nipples above the location for installation of a casing patch. Lengths 27 and 28 of the first and second anchor/seals 12 and 13 may each be defined as the lengths of the sections with internal diameters less than the internal diameter 8 of the base tubular 11. The first and second anchor/seals 12 and 13 may be manufactured by swaging of the base tubular 11 or separately by machining or swaging and then connecting to the base tubular 11 by welding or by threaded connections at a distance 33 between them.

Figure 3:
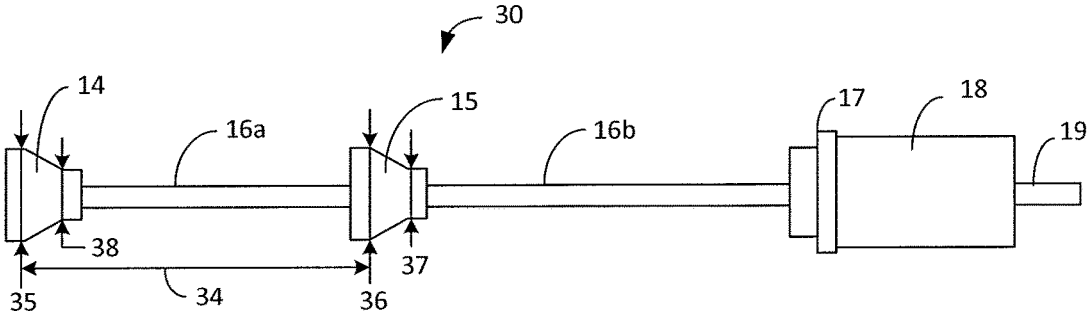
FIG. 3 is a schematic view of the expansion tool of the system shown in FIG. 1.

FIG. 3 illustrates schematically expansion tool 30 of the casing patch system 10. The tool 30 comprises the first expansion device 14 solidly connected to the shaft 16*a*, the second expansion device 15 solidly connected to both shaft 16*a* and a shaft 16*b*, the releasable support 17 slidably connected to the shaft 16*b*, the thruster 18, and conduit 19 connected to the thruster 18. The first expansion device 14 may be a conical device, such as a swage, with a front small diameter 38 approximately equal to the internal diameter 25 of the first anchor/seal 12, and a back large diameter 35 approximately equal to the internal diameter 8 of the base tubular 11. The second expansion device 15 may be a conical device, such as a swage, with a front small diameter 37 approximately equal to the internal diameter 21 of the second anchor/seal 13, and a back large diameter 36 approximately equal to the internal diameter 8 of the base tubular 11. The conduit 19 may be a wireline comprising an electric pump for providing pressure in the thruster 18. Alternatively, conduit 19 may be a drill pipe or a coiled tubing capable of providing pressure to the thruster 18. Alternatively, the thruster 18 may be an explosive device capable of providing necessary expansion force with a stroke not less than the combined distance of lengths 27 and 28 of first and second anchor seals 12 and 13, respectively. The first and second expansion devices 14 and 15 may be positioned at a distance 34 defined as a distance between the large diameters 35 and 36. The distance 34 between first and second expansion devices 14 and 15 may be selected to be approximately equal to the distance 33 between the first and second anchor/seals 12 and 13, see FIG. 2, such that upon expansion of the first anchor/seal 12 by the first expansion device 14, the second expansion device 15 may engage the second anchor/seal 13.

Figure 4:
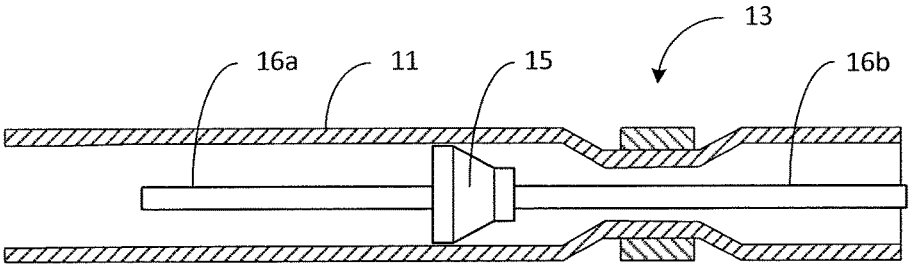
FIGS. 4-6 illustrate the steps in assembling the casing patch system shown in FIG. 1.
Figure 5:
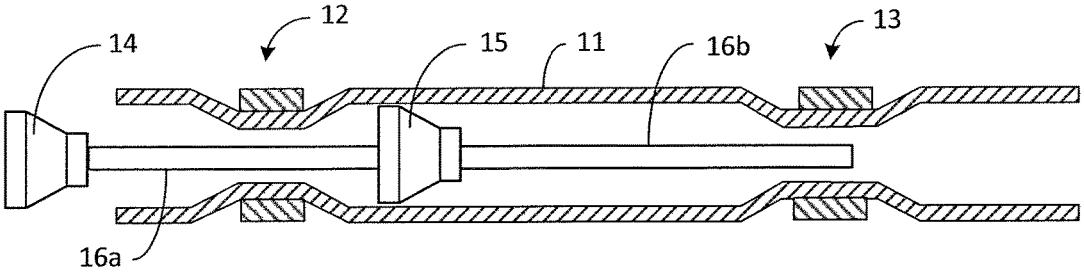
Figure 6:
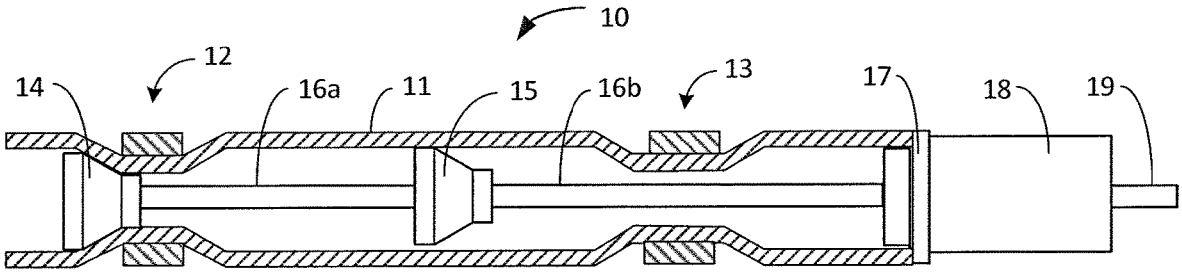

FIGS. 4, 5, and 6 conceptually demonstrate one possible method of assembling casing patch system 10. In the first step, FIG. 4, the casing patch 20 comprises base tubular 11 with second anchor/seal 13. The second expansion device 15 is attached to first and second shafts 16*a* and 16*b* and positioned inside the base tubular 11. In the second step, FIG. 5, the first anchor/seal 12 is attached to the base tubular 11, and then the first expansion device 14 is attached to the first shaft 16*a*. Finally, in the third step, FIG. 6, the second shaft 16*b* is attached to the releasable support 17 and the thruster 18 completing the assembling of casing patch system 10.

Figure 7:
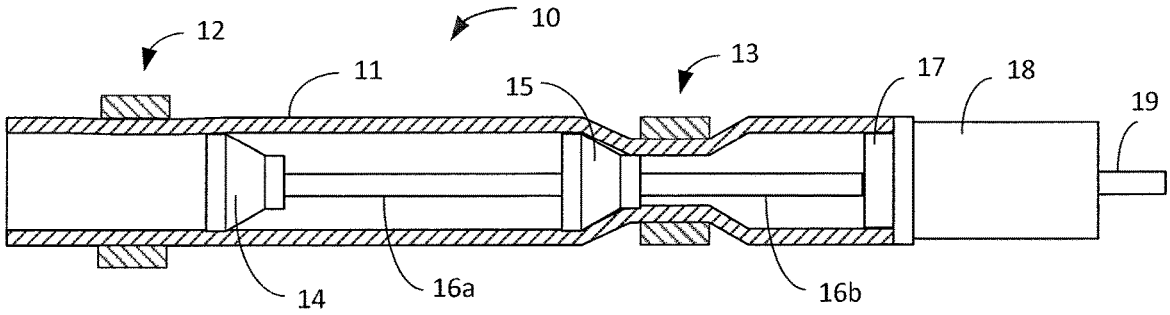
FIGS. 7 and 8 illustrate the steps in sequential expansion of the anchor/seals of the system shown in FIG. 1.
Figure 8:
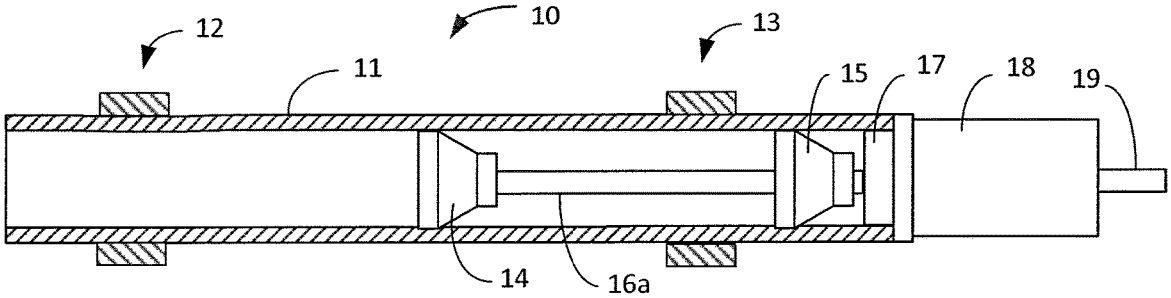

In operation, the casing patch system 10, see FIG. 6, may be deployed into a wellbore on the conduit 19 to a desired location. Then, the thruster 18 is pressurized pulling the first and second expansion devices 14 and 15 towards the thruster 18. The expansion of the first and second anchor/seals 12 and 13 takes place sequentially; first, expansion of the first anchor/seal 12 by the first expansion device 14, see FIG. 7, bringing first anchor/seal 12 into interference contact with wellbore casing (not shown); and only afterwards, expansion of the second anchor/seal 13 by the second expansion device 15, see FIG. 8, bringing the second anchor/seal 13 into interference contact with wellbore casing (not shown) also. Then, the expansion tool 30 can be removed from the well by simply pulling it by the conduit 19. Providing that the length of the stroke of thruster 18 is not less than the sum of the lengths 27 and 28 of the first and second anchor/seals 12 and 13, see FIG. 2, the setting of the casing patch 20 can be accomplished in one stroke of the thruster 18, which eliminates the need for resetting and re-anchoring the thruster 18. Also, the sequential expansion of the first and second anchor/seals 12 and 13 significantly reduces the expansion forces.

Figure 9:
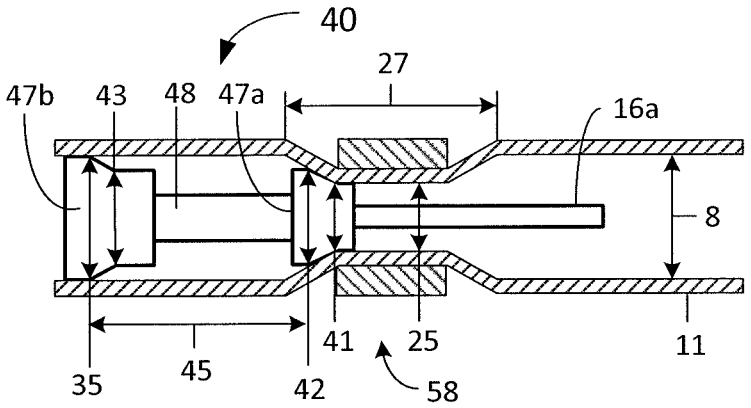
FIG. 9 illustrates a dual swage expansion device.
Figure 10:
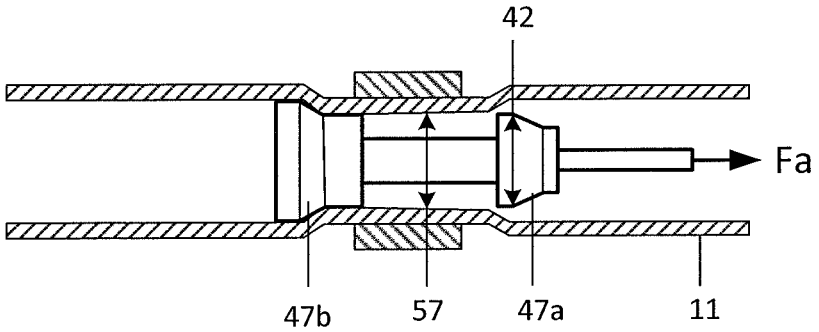
FIGS. 10 and 11 illustrate the steps in expanding an anchor/seal by dual swage expansion device shown in FIG. 9.
Figure 11:
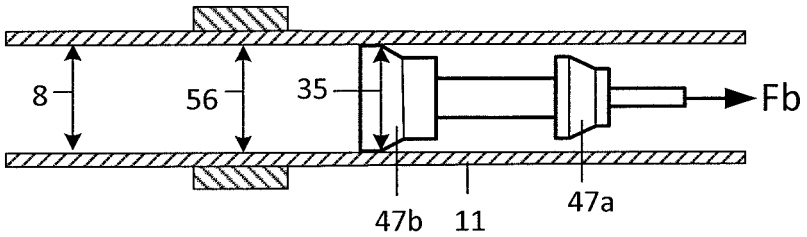

In some cases, a wellbore may have a restriction, which may have a diameter significantly less than the internal diameter of the casing, above where the casing patch 20 needs to be installed. This requires the use of first and second anchor/seals 12 and 13 with internal diameters 25 and 21, respectively, that may be significantly less than the internal diameter 8 of the base tubular 11. In this scenario, first and second anchor/seals 12 and 13 require a high degree of expansion, in some cases up to 70%, to be cladded to the wellbore casing. The high degree of expansion requires exceedingly high expansion forces if expanded with a single swage which may cause localized buckling of the first and second anchor/seals 12 and 13 or the base tubular 11 during seal expansion. FIG. 9 shows schematics of an alternative expansion device 40 which may overcome this limitation. The expansion device 40 comprises a shaft 48 and two swages: a front swage 47*a* and a rear swage 47*b* solidly attached to the shaft 48 and positioned at a distance 45, which may not be less than the length 27 of an anchor/seal 58. The front swage 47*a* has a diameter 42 which is smaller than the diameter 35 of rear swage 47*b*. The expansion device 40 expands anchor/seal 58 sequentially in two steps: first by front swage 47*a*, FIG. 10, expanding internal diameter 25 of the anchor/seal 58 to a diameter 57, which may be approximately equal to the diameter 42 of front swage 47*a* with expansion Force, Fa, and then by the rear swage 47*b* to an internal diameter 56, which may be approximately equal to the diameter 35 of rear swage 47*b* with expansion Force, Fb.

The diameter 35 of the rear swage 47*b* is selected to be substantially equal to the internal diameter 8 of the base tubular 11, and a small diameter 43 of rear swage 47*b*, which may be approximately equal to the large diameter 42 of the front swage 47*a*. A small diameter 41 of the front swage 47*a* may be approximately equal to the internal diameter 25 of the anchor/seal 58. To minimize expansion forces, the expansion force Fa for expanding anchor/seal 58 by front swage 47*a* should be approximately equal to the expansion force Fb for expanding anchor/seal 58 by the rear swage 47*b*. Equalization of forces Fa and Fb, depending on the properties of the anchor/seal material (e.g. strain hardening), may be achieved by selecting the ratio of the diameter 42 of front swage 47*a* to the diameter 35 of rear swage 47*b* in the range of 0.55 to 0.8.

Figure 12:
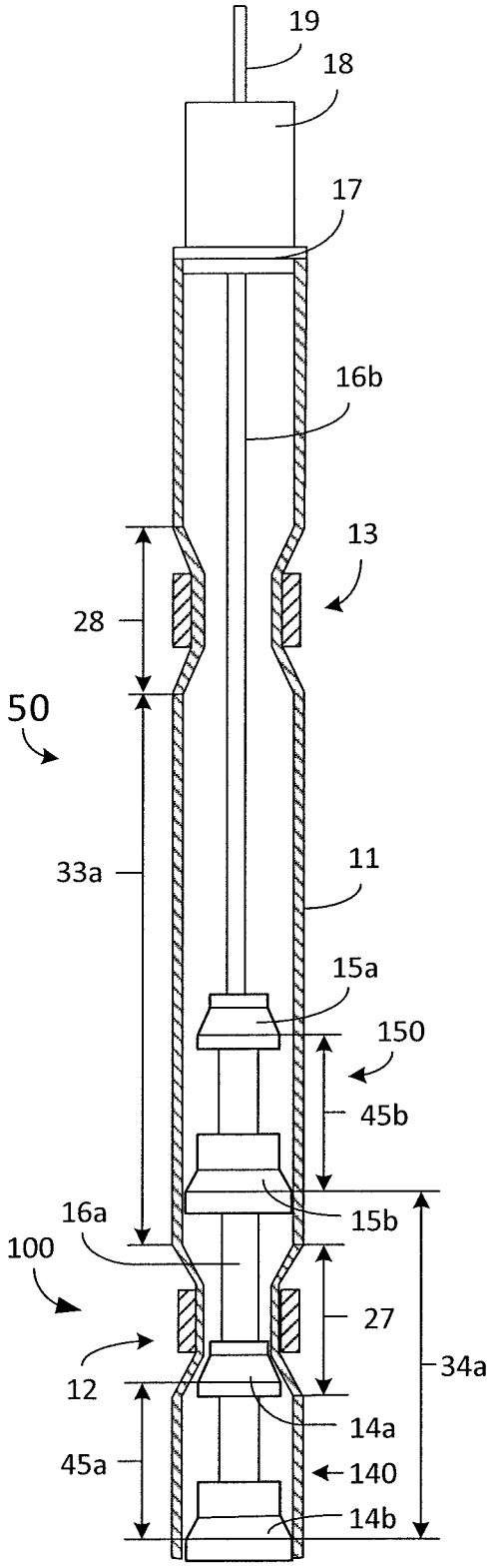
FIG. 12 is a schematic view of the casing patch system with dual swage expansion devises.

FIG. 12 illustrates an alternative embodiment of a casing patch system 50, which is a modification of casing patch system 10 described above. The system 50 comprises base tubular 11 with first and second anchor/seals 12 and 13 as well as an expansion tool 100 comprising a first double-swage expansion device 140 and a second double-swage expansion device 150. The first double-swage expansion device 140 may comprise a front swage 14*a* and a back swage 14*b* positioned at a distance 45*a*, which may be approximately equal to the length 27 of the first anchor/seal 12. The second double-swage expansion device 150 comprises a front swage 15*a* and a back swage 15*b* positioned at a distance 45*b*, which may be approximately equal to the length 28 of the second anchor/seal 13. A distance 34*a* between the first and the second expansion devices 140 and 150 may be approximately equal to a length 33*a* of the base tubular 11 between the first and second anchor/seals 12 and 13 minus the distance 45*a* between front swage 14*a* and back swage 14*b* of the first expansion device 140. This allows sequential expansion of the first anchor/seal 12 and then the second anchor/seal 13 with the expansion forces significantly less compared to the expansion with the first and second expansion devices 14 and 15 with single swages and minimizes the length of the stroke for setting both first and second anchor/seals 12 and 13.

Figure 13:
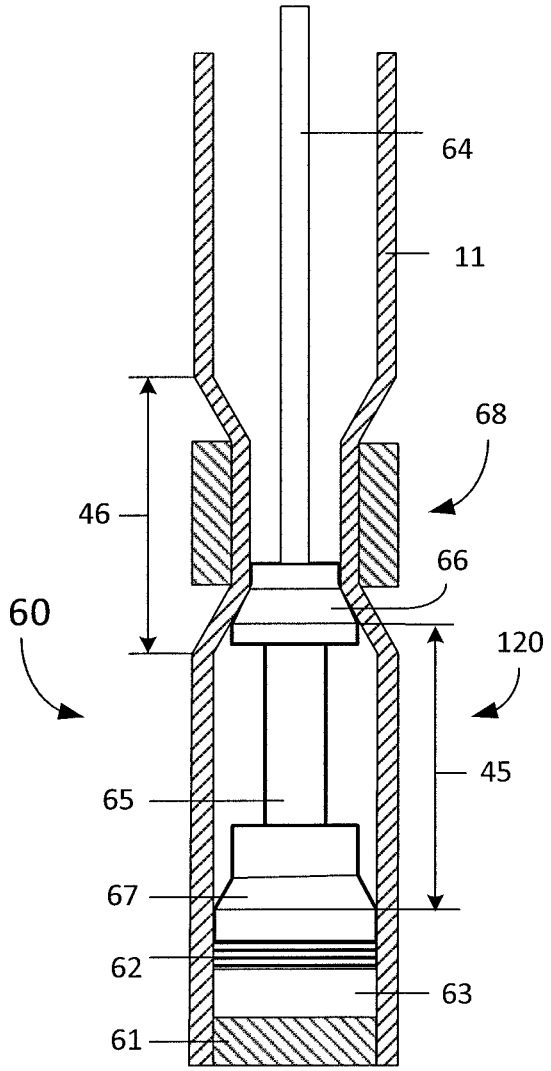
FIG. 13 is a schematic view of hydraulically expandable casing patch system with dual swage expansion device.

A double-swage expansion device may also be used for expanding one or more anchor/seals by pressure applied inside the base tubular 11 in the chamber below the expansion device. As discussed above, in the cases when the setting of the anchor/seals in the casing requires high expansion ratios, the expansion force in the case of expansion devices with a single swage may become exceedingly high in the sense that the pressure in the chamber necessary to generate this force may exceed the burst pressure of the base tubular 11. A double-swage expansion device may reduce expansion force and therefore necessary pressure due to sequential expansion of an anchor/seal first by a small swage and then by a larger swage. In another alternative embodiment, a casing patch system 60, see FIG. 13, comprises base tubular 11 with anchor/seal 68 and a shoe 61 threadably attached to the base tubular 11. An expansion tool comprises a double-swage expansion device 120 with a front swage 66 having diameter less than the diameter of a back swage 67. The front and back swages 66 and 67 may be solidly attached to a shaft 65 at the distance 45 not less than a length 46 of the anchor/seal 68. The back swage 67 may have a seal 62 creating a pressure chamber 63 between the shoe 61 and the back swage 67. Both front and back swages 66 and 67 and the shaft 65 have a liquid passage to communicate pressurized liquid from a conduit 64 to the pressure chamber 63. As discussed above, swage diameters may be selected such that pressure for expanding anchor/seal 68 by front swage 66 and by the back swage 67 may be equal to minimize pressure necessary for setting anchor/seal 68 in the well casing (not illustrated). Thus, casing patch system 60 may be deployed and set to the well casing by using a wireline with an electric pressure pump, or alternatively on a coiled tubing or a drill pipe providing pressure from the surface, even in the cases requiring high degrees of anchor/seal expansion, which is currently unachievable.

Upon application of pressure, the anchor/seal 68 is expanded first by the front swage 66 and then by the back swage 67 significantly reducing the pressure necessary for setting anchor/seal 68 in the well casing compared to a single swage system.

Although the expansion devices illustrated in FIGS. 9-13 have two swages, the expansion devices may have any number of swages without departing from the principles of the present invention. For instance, the expansion devices may have three swages, each having a front swage with a diameter less than a middle swage and a back swage with a diameter larger than the front and middle swages. Also, the casing patch system 10 illustrated in FIG. 1 may be reconfigured by positioning the second expansion device 15 in the vicinity of the second anchor/seal 13 and the first expansion device 14 below the first anchor/seal 12 at the distance approximately equal to the length 28 (FIG. 2) of the second anchor/seal 13. In this configuration upon stroking of the thruster 18, the second anchor/seal 13 may be initially expanded and then the first anchor/seal 12 may also be expanded, reducing expansion force and minimizing the length of the stroke of thruster 18.

Although the present invention and its advantages have been described in detail, it should be understood that various changes, substitutions and alterations may be made herein without departing from the spirit and scope of the invention as defined by the appended claims.

The invention claimed is:

1. A casing patch stem, comprising:

a base tubular comprising a first anchor/seal and a second anchor/seal coupled to the base tubular, wherein the internal diameters of the first and the second anchor/seals are less than the internal diameter of the base tubular;

an expansion tool comprising:

a first expansion device fixedly secured to a shaft, and a second expansion device fixedly secured to the shaft, wherein the second expansion device is positioned inside the base tubular between the first and second anchor/seals, and further wherein the distance between the first and second expansion devices is selected, such that upon expansion of the first anchor/seal by the first expansion device the second expansion device approximately engages the second anchor/seal; and a thruster coupled to the shaft and capable of providing a force necessary for expansion of the first and second anchor/seals.

2. The system of claim 1, wherein the first expansion device or the second expansion device comprises a swage.

3. The system of claim 1, wherein the first expansion device or the second expansion device comprises a front swage and a back swage connected by a secondary shaft, wherein the outer diameter of the front swage is less than the outer diameter of the back swage.

4. The system of claim 3, wherein the distance between the front and back swages is not less than the length of the first anchor/seal or the second anchor/seal.

5. The system of claim 4, wherein the expansion forces for expansion of the first and second anchor/seals by the front and back swages are approximately equal.

6. The system of claim 1, further comprising a wireline.

7. A casing patch system, comprising:

a base, tubular comprising at least one anchor/seal coupled to the base tubular, wherein the internal diameter of the at least one anchor/seal is less than the internal diameter of the base tubular;

an expansion tool comprising an expansion device, which comprises a front swage and a back swage, wherein the front and back swages are fixedly secured to a shaft with a distance between the front swage and the back swage not less than the length of the at least one anchor/seal, and further wherein the front swage, the back swage, and the shaft comprise a fluid passage, and further wherein the front swage has an outer diameter less than the outer diameter of the back swage.

8. The system of claim 7, wherein the outer diameters of the front and back swages are such that the expansion forces necessary for expansion of the at least one anchor/seal by the front and back swages are approximately equal.

9. The system of claim 7, further comprising a thruster.

10. The system of claim 7, further comprising a shoe coupled to the base tubular.

11. The system of claim 10, wherein the back swage comprises a seal thereby creating a pressure chamber between the shoe and the seal.

12. The system of claim 7, further comprising a wireline.

13. A method of installation of a casing patch in a borehole in a subterranean formation comprising:

deploying a casing patch system to a desired location in the borehole;

wherein the easing patch system comprises:

a base tubular comprising a first anchor/seal and a second anchor/seal coupled to the base tubular, wherein the internal diameters of the first and the second anchor/seals are less than the internal diameter of the base tubular;

an expansion tool comprising:

a first expansion device fixedly secured to a shaft, and a second expansion device fixedly secured to the shaft wherein the second expansion device is positioned inside the base tubular between the first and second anchor/seals, and further wherein the distance between the first and second expansion devices is selected such that upon expansion of the first anchor/seal by the first expansion device the second expansion device approximately engages the second anchor/seal; and a thruster coupled to the shaft and capable of providing a force necessary for expansion of the tint and second anchor/seals;

activating the thruster and radially expanding first and second anchor/seals in interference contact with a borehole casing, and removing the expansion tool out of the borehole.

14. The method of claim 13, wherein the first expansion device or the second expansion device comprises a swage.

15. The method of claim 13, wherein the first expansion device or the second expansion device comprises a front swage and a back swage connected by a secondary shaft, wherein the outer diameter of the front swage is less than the outer diameter of the back swage.

16. The method of claim 15, wherein the distance between the front and hack swages is not less than the length of the first anchor/seal or the second anchor/seal.

17. The method of claim 16, wherein the expansion forces for expansion of the first and second anchor/seals by the front and back swages are approximately equal.

18. The method of claim 13, further comprising a wireline.

19. The method of claim 13, wherein the thruster is an explosive device.

* * * * *